US007055545B2

(12) United States Patent
Mascari et al.

(10) Patent No.: US 7,055,545 B2
(45) Date of Patent: Jun. 6, 2006

(54) MODULAR CENTER SET FAUCET AND VALVE BODY

(75) Inventors: Nicholas A. Mascari, Newburgh Heights, OH (US); Martin Zummersch, Lakewood, OH (US); W. Britt Warren, New Bern, NC (US); John A. Griffin, New Bern, NC (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 11/008,594

(22) Filed: Dec. 9, 2004

(65) Prior Publication Data

US 2005/0098221 A1 May 12, 2005

Related U.S. Application Data

(62) Division of application No. 10/361,914, filed on Feb. 10, 2003, now abandoned.

(51) Int. Cl.
*E03C 1/04* (2006.01)

(52) U.S. Cl. ..... 137/359; 137/801

(58) Field of Classification Search ..... 137/359, 137/606, 801

See application file for complete search history.

(56) References Cited

U.S. PATENT DOCUMENTS

| | | | |
|---|---|---|---|
| 2,591,991 | A | 4/1952 | Young |
| RE30,559 | E | 3/1981 | Schmitt |
| 4,735,357 | A | 4/1988 | Gregory et al. |
| 4,976,287 | A | 12/1990 | Sheen |
| 5,027,851 | A | 7/1991 | Drees et al. |
| 5,131,428 | A | 7/1992 | Bory |
| 5,158,234 | A | 10/1992 | Magnenat et al. |
| 5,165,121 | A | 11/1992 | McTargett et al. |
| 5,232,008 | A | 8/1993 | Jeffress et al. |
| 5,518,016 | A | 5/1996 | Sharwark |
| 5,669,417 | A | 9/1997 | Lian-Jic |
| 5,873,387 | A | 2/1999 | Weber et al. |
| 6,138,296 | A | 10/2000 | Baker |
| 6,170,098 | B1 | 1/2001 | Pitsch |
| 6,175,972 | B1 | 1/2001 | Wales |
| 6,256,810 | B1 | 7/2001 | Baker |
| 6,279,604 | B1 | 8/2001 | Korb et al. |
| 6,301,727 | B1 | 10/2001 | Bertrand et al. |
| 6,345,643 | B1 | 2/2002 | Ko |
| 6,360,770 | B1 | 3/2002 | Buchner et al. |
| 6,401,748 | B1 | 6/2002 | Wang |

*Primary Examiner*—John Fox
(74) *Attorney, Agent, or Firm*—Calfee, Halter & Griswold LLP

(57) ABSTRACT

A modular faucet bar spout in which trim may be removed or reinstalled from above a sink deck without affecting the waterway connections beneath the sink deck is disclosed. Each faucet or spout includes a valve body wit a trim set. The valve body includes a pair of tubular conduits spaced apart to extend through passages in the sink deck and a cross conduit connecting the tubular conduits. A water outlet nipple leads from the cross conduit and has a slide-on fitting located above the sink deck when the conduits are positioned to extend through the passages. The trim set includes an escutcheon, an adapter and a spout. The escutcheon has an open bottom and a spout connecting passage formed in its top surface. The adapter is positioned in the escutcheon and has a slide-on inlet connection to receive and connect to the water outlet nipple of the valve body.

18 Claims, 4 Drawing Sheets

MODULAR CENTER SET FAUCET AND VALVE BODY

CROSS-REFERENCE TO RELATED APPLICATIONS

This application is a divisional of prior application Ser. No. 10/361,914, filed on Feb. 10, 2003, now abandoned.

THE FIELD OF THE INVENTION

The present invention relates to what are termed "modular" center set faucets and bar spouts and in particular to a center set faucet or a bar spout faucet in which the faucet trim or bar spout trim maybe removed or reinstalled from above the sink deck without affecting the waterway connections beneath the sink deck. This invention permits the decorative portion of the plumbing fixture, the faucet trim set, or the bar spout trim set, to be removed and replaced without affecting the plumbing connections and without requiring the use of any special tools. The ability to make such changes is particularly advantageous for consumers who are remodeling and wish to change a plumbing fixture, and to builders who offer upgraded fixtures in new construction and who wish to avoid the necessity of purchasing an entirely new plumbing fixture and the consequent installation expense.

With the present invention, the valve body, the faucet trim set and the bar spout trim set become separate parts. The valve body is installed on the sink deck prior to the installation of the faucet trim set or bar spout trim set. The customer may delay a decision as to the style and design of the faucet trim set or bar spout trim set to a later time. The faucet trim set or bar spout trim set may be replaced or exchanged after installation without removing the valve body. The faucet trim set or bar spout trim set may be installed or removed without the use of special tools such as Allen wrenches.

SUMMARY OF THE INVENTION

The present invention relates to modular plumbing fixtures and in particular to a faucet assembly of a valve body and a trim set can be installed and removed from a sink deck without affecting its valve body and its underlying waterway connections. The trim set may be a two handled centerset faucet, a two handled bar spout or any other similar two handled faucet.

A primary purpose of this invention is to provide a modular plumbing fixture for water control in which the portion of the plumbing fixture visible to the user may be changed without disturbing the underlying waterway connections.

Another purpose is to provide a two handled faucet assembly for installation on a sink deck in which the faucet assembly includes a valve body which is installed on the sink deck and connected to its water supplies and a trim set which is pre-assembled for ease of attachment to and removal from the sink deck without the use of special tools.

Other purposes of the invention will appear in the following specification, drawings and claims.

BRIEF DESCRIPTION OF THE DRAWINGS

The invention is illustrated diagrammatically in the following drawings where.

DESCRIPTION OF THE PREFERRED EMBODIMENTS

Figure 1:
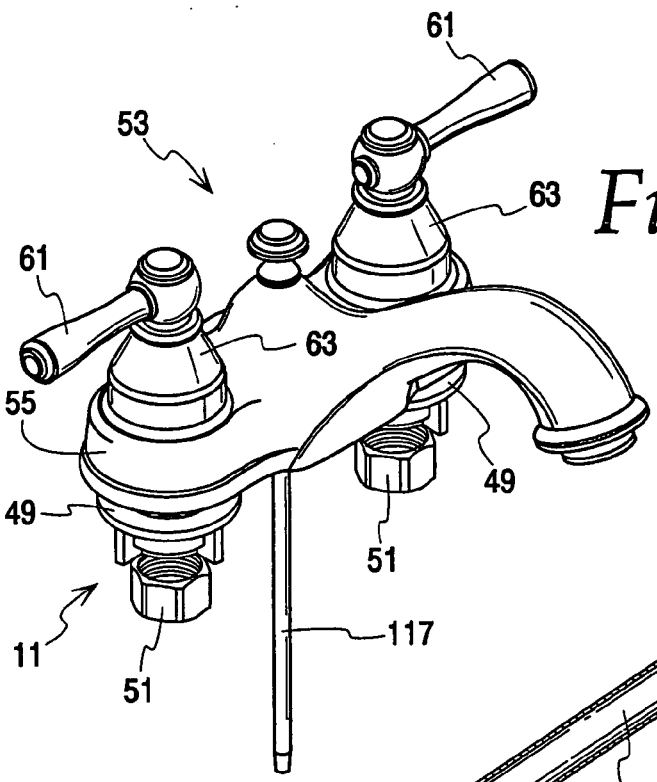
FIG. 1 is a perspective view, partially exploded, of a trim set for a two handled faucet of this invention.
Figure 4:
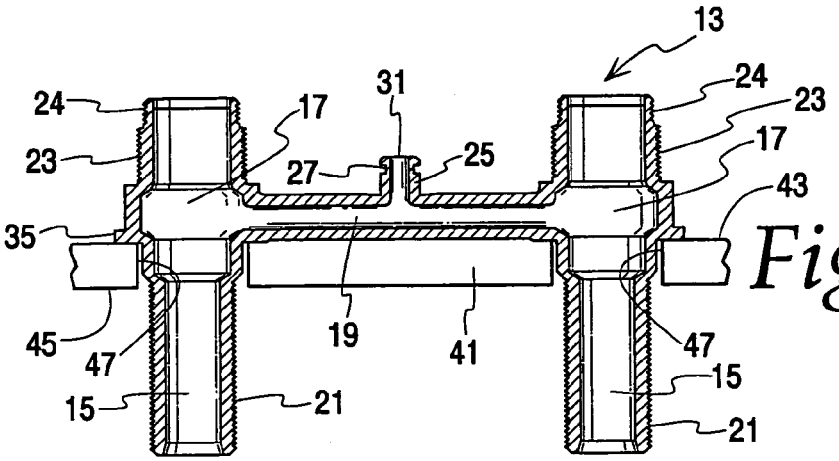
FIG. 4 is a longitudinal cross-sectional view of the valve body of FIG. 3.

Two modular faucets embodying the novel aspects of this invention are shown in the drawings. A first embodiment of a two handled centerset faucet 11 is shown in FIGS. 1–5 of the drawings and a second embodiment of a bar spout faucet assembly is shown in FIGS. 6–9 of the drawings. FIG. 1 shows a two handled centerset faucet trim 11 with parts such as a sink deck and water pipe connections omitted for clarity of illustration. The valve body 13 is shown in detail in FIGS. 2 and 3 of the drawings and in cross section in FIG. 4. The valve body includes a pair of tubular conduits 15 each having a cartridge chamber 17 and connected integrally by a cross conduit 19. The tubular conduits include exterior threads 21 located below the cross conduit, exterior threads 23 for handle bonnets located above the cross conduit and exterior threads 24 for cartridge nuts located above the exterior threads 23. Also formed integrally with the cross conduit 19 is an upstanding nipple 25 having a circumferential groove 27 and an O-ring 29 located in the groove. A water outlet 31 is formed in the end of the nipple. The cross conduit is notched at 33 to provide clearance for a lift rod to be later described. A somewhat annular flange 35 surrounds the tubular conduits to engage a sink deck 41, specifically the upper surface 43 of the sink deck as shown in FIG. 4. The sink deck also has an under surface 45 with passages 47 extending between the upper and under surfaces. Mounting nut washers 49 engage the threads 21 and the under surface 45 of the sink deck to secure the valve body 13 to the under surface of the sink deck. Tail piece nuts 51 are conventional and are used to connect the water conduits to the tubular conduits 15 of the valve body.

Figure 2:
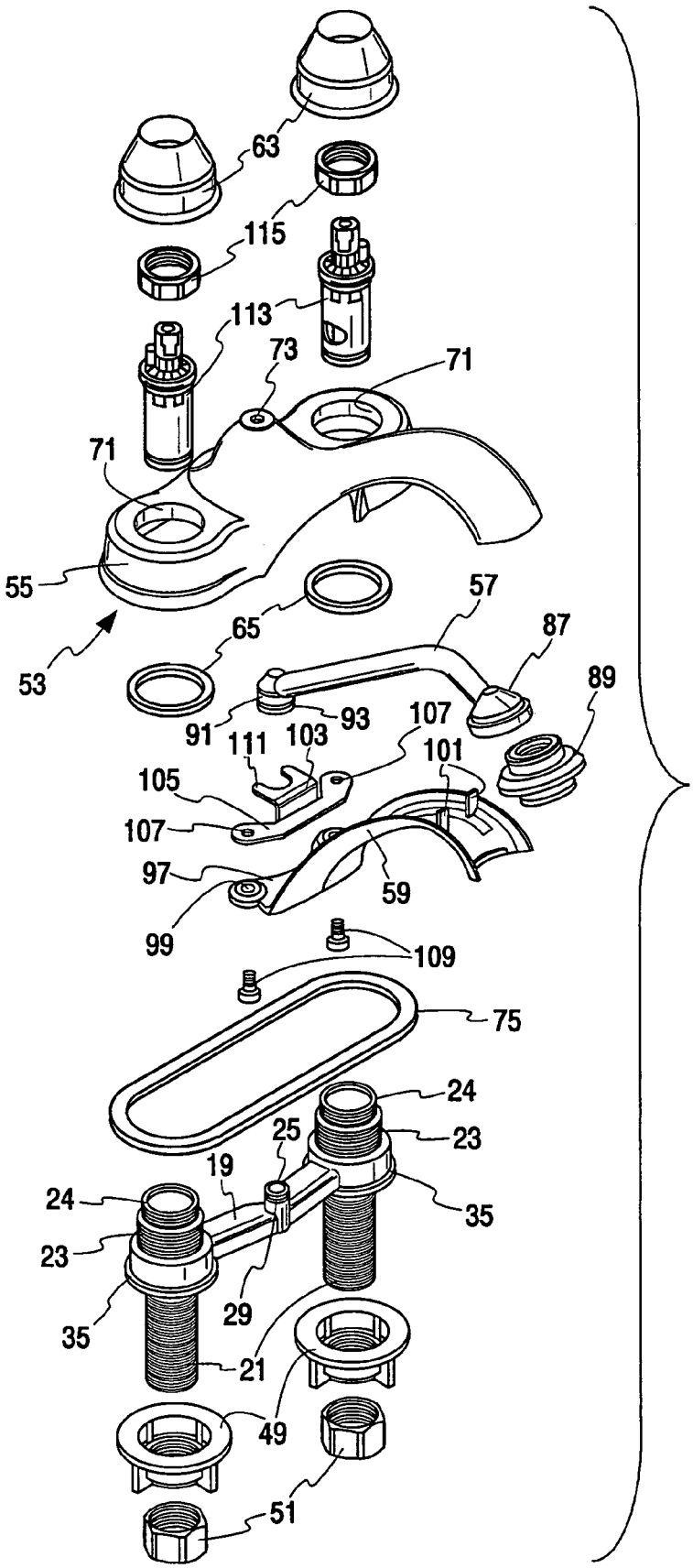
FIG. 2 is an exploded perspective view of a modular faucet assembly of this invention.

The centerset trim set 53 is shown in exploded view in FIG. 2 of the drawings. It includes an escutcheon 55 which fits on the sink deck 41, a waterway 57 which fits inside the escutcheon and a throat plate 59 that closes the under side of the escutcheon to conceal the waterway. Conventional handles 61 and handle bonnets 63, shown in FIG. 1 of the drawings, are mounted on the valve body 13 engaging threads 23 of the tubular conduits 15 in a conventional manner. Gaskets 65 are positioned between the valve body 13 and the handle bonnets 63. A pair of passages 71 are formed in the escutcheon 55 to receive the threads 23 of the valve body 13. A passage 73 is provided for the plunger lift rod and a deck gasket 75 is provided to fit inside the bottom of the escutcheon 55.

Figure 5:
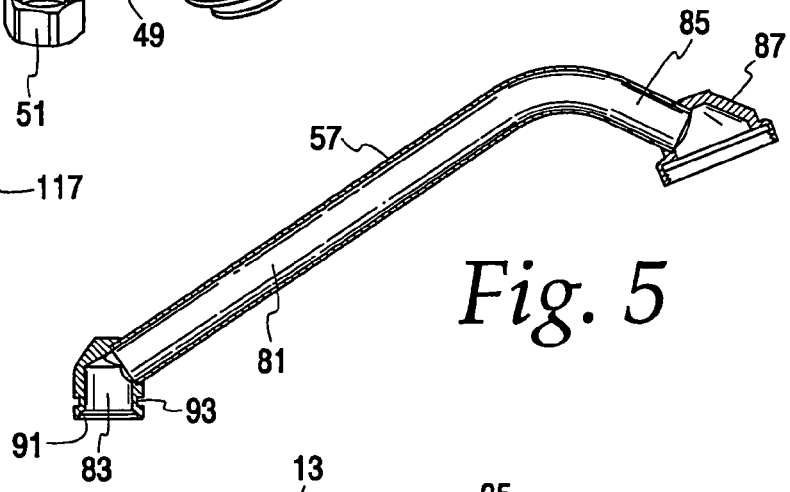
FIG. 5 is a longitudinal cross-sectional view of the trim set waterway.
Figure 3:
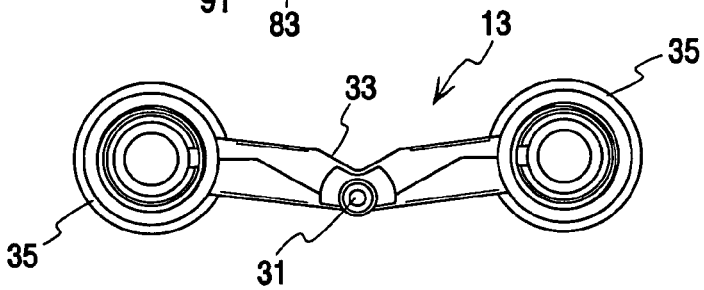
FIG. 3 is a top plan view of the valve body of this invention.

The waterway 57, as most clearly shown in FIG. 5 of the drawings, includes an interior conduit 81 which leads the water from an inlet 83 to an outlet 85. A socket 87 is formed at the outlet end to receive an aerator 89. At the inlet end, an inlet socket 91 is formed with an exterior circumferential groove 93 and is adapted to fit over the nipple 25 of the valve body 13 with the O-ring 29 in the groove 27 of the nipple 25 functioning as a water seal enabling the centerset trim set 53 to be slid on to and connected to the valve body 13.

The throat plate 59, which encloses the waterway 57 positioned in the escutcheon 55, includes a base plate 97 having eyelets 99. The throat plate also includes prongs 101 which fit into sockets (not shown) positioned inside the escutcheon to support the throat plate at the under side of the escutcheon. A waterway clip 103 is formed with screw passages 107 which receive screws 109 which also pass through the eyelets 99 of the throat plate base 97 to fasten the waterway clip 103 to the throat plate. The waterway clip has a yoke 111 which fits into the annular groove 93 formed on the inlet socket 91 to connect the waterway 57 to the throat plate 59.

As is conventional, cartridges 113 fit into the cartridge chambers 17 in the valve body 13 and are held in place by cartridge nuts 115 which thread over the threads 24 at the upper end of the tubular conduits 15 and are concealed by the faucet bonnets 63.

When the waterway 57 is inserted into the escutcheon 55, the centerset trim set 53 is ready to be fastened on the valve body 13 which has been previously installed on the sink deck 43. The passages 71 in the escutcheon will fit over and allow passage of the threads 23 of the tubular conduits 15. Thus, it is possible to install the trim set 53 directly on the valve body with the inlet socket 91 of the waterway 57 fitting over and receiving the nipple 25 of the cross conduit 19 of the valve body. A push-on watertight connection is obtained as the inlet socket 91 compresses the O-ring 29 located in the groove 27 of the nipple. Thus, it is possible to lift the trim set 53 onto and remove it from the valve body 13 without disturbing the connections of the valve body to the water supplies. The escutcheon 55 is secured in place by fastening the handle bonnets 63 by threading them onto the threads 23 on the top of the tubular conduits 15. The faucet handles 61 are then connected to the valve cartridges 113 to complete the installation of the faucet set.

A second embodiment of the invention is shown in FIGS. 6–9 of the drawings. The two handled bar spout faucet 151, shown in front elevational view in FIG. 6 of the drawings and in exploded view in FIG. 7, consists of a trim set 153 which can be used to replace the centerset trim set 53 on the valve body 13. The trim set includes an escutcheon 155, a spout assembly 157, a spout adapter 159, a spout 161 and a spout hub 163. Passages, which are not shown but are similar to passages 71 in the escutcheon 55 of the first embodiment of the invention, are formed in the escutcheon 155 which receive the threads 23 of the tubular conduits 15 of the valve body 13. An additional passage 171 for the spout adapter 159 is formed in the escutcheon and this passage includes a flat wall 173 at the rear of the escutcheon and a curved notch 175 at the front of the escutcheon. There is also a passage 177 for the plunger lift rod formed in the escutcheon. To enable the escutcheon 155 to be mounted on the valve body 13, the spout adapter 159 has a water inlet socket 181 (FIG. 9) which is sized to fit over and receive the nipple 25 of the valve body 13. At the opposite side of the adapter, there is an outlet 183 having external threads 184 formed thereon. An internal shoulder 185 is formed in the outlet 183. A flat wall 187 is formed on one side of the adapter.

Figure 8:
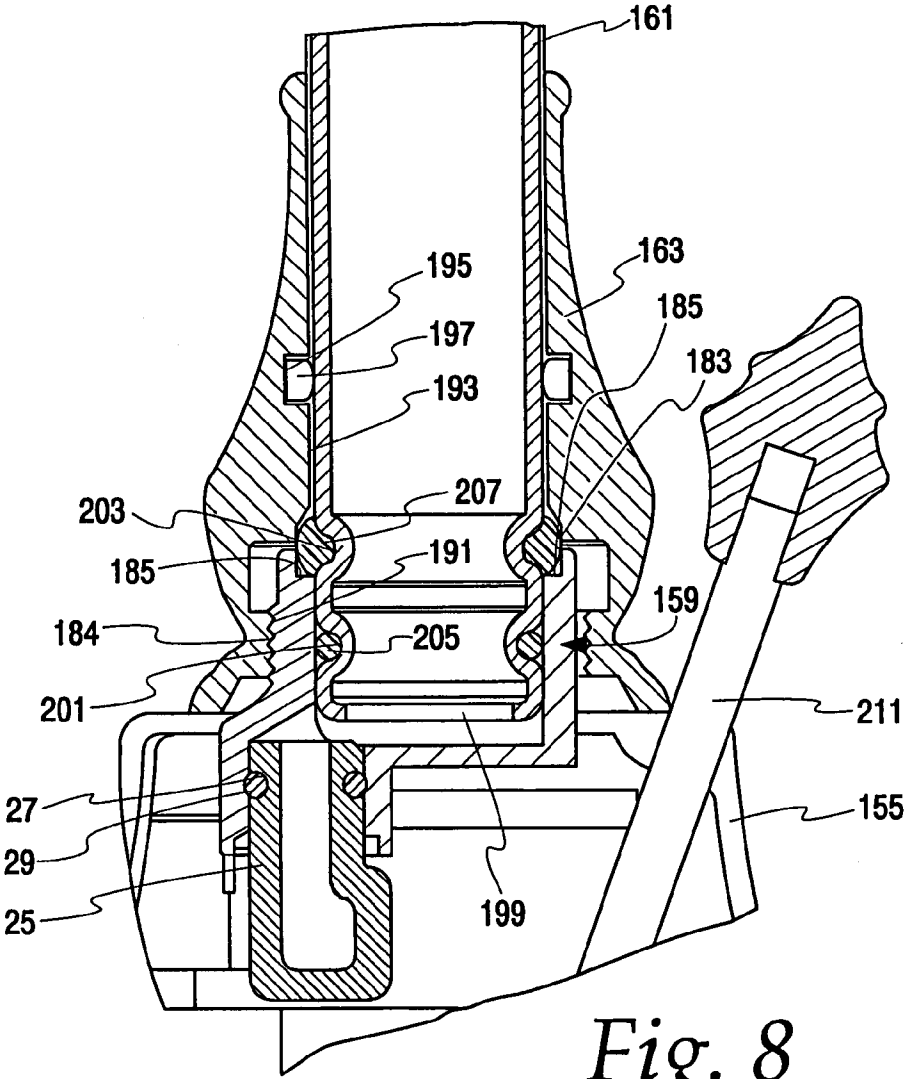
FIG. 8 is an enlarged, partial, cross-sectional view of the faucet spout and escutcheon of FIG. 6.
Figure 6:
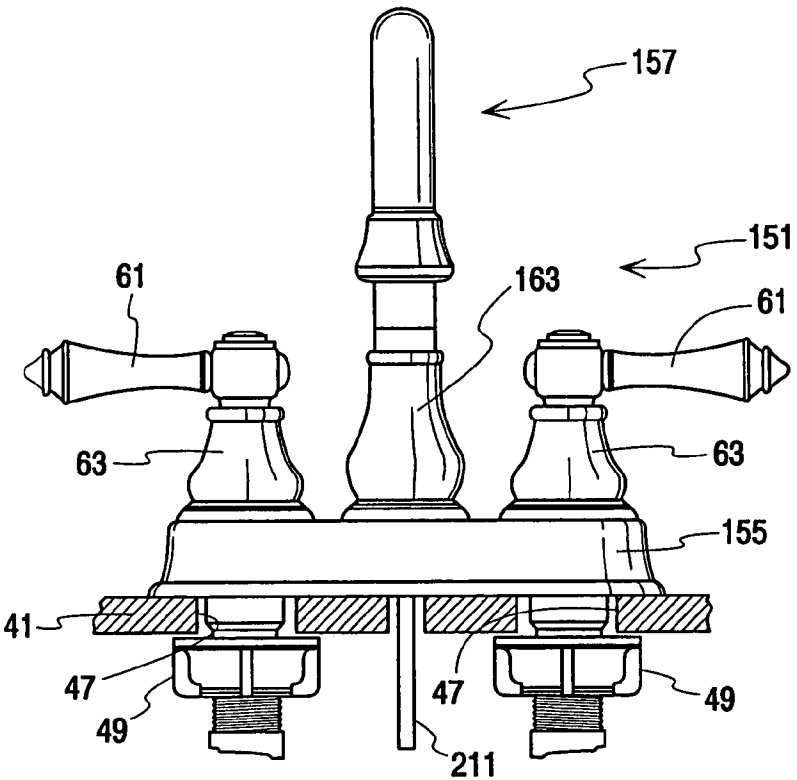
FIG. 6 is a front elevational view of a bar spout faucet mounted on a sink deck.
Figure 7:
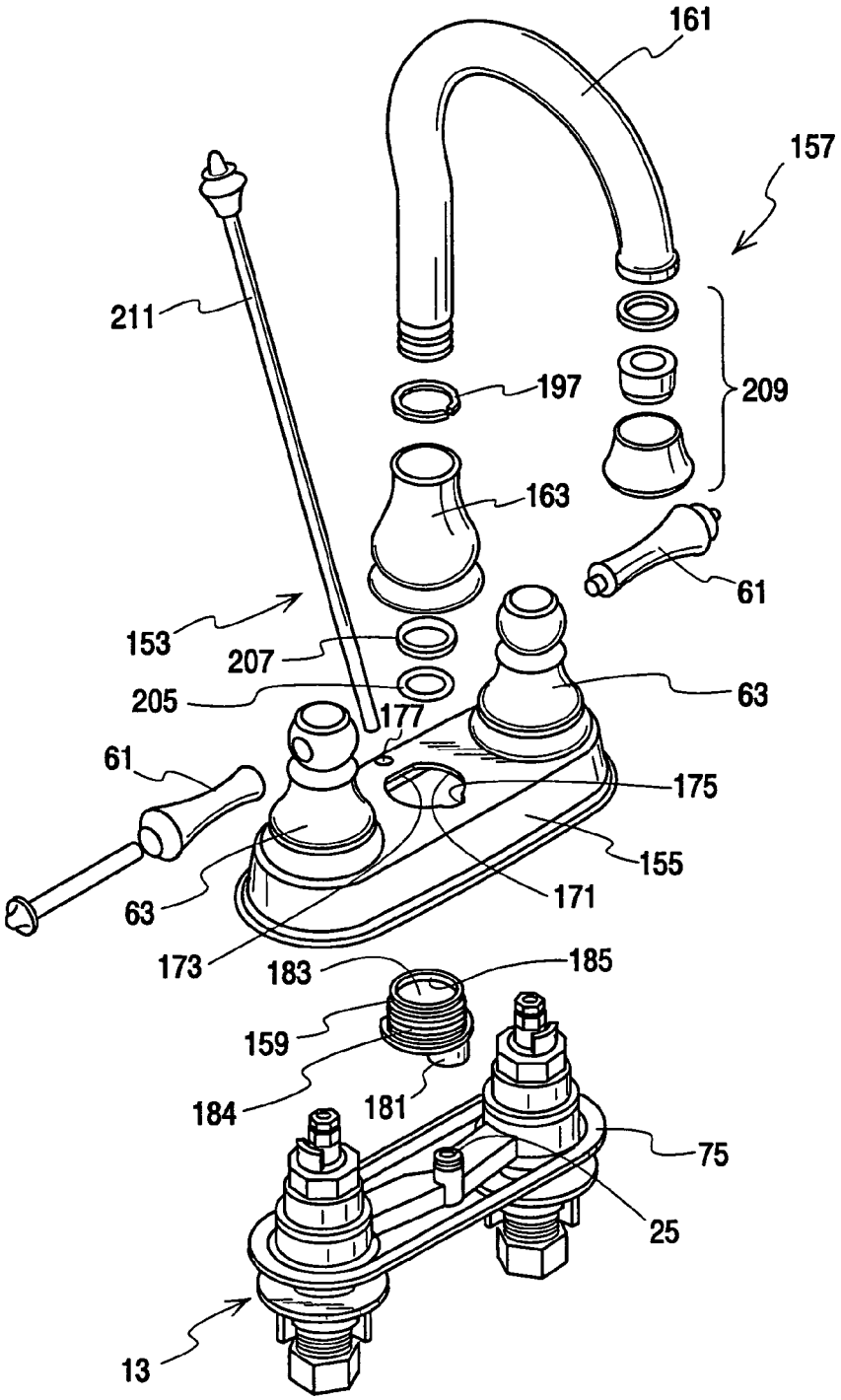
FIG. 7 is an exploded perspective view of a bar spout faucet of this invention.
Figure 9:
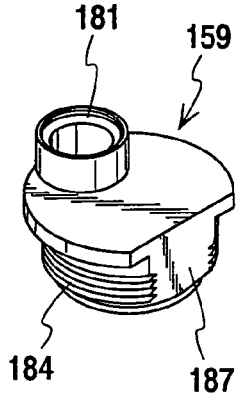
FIG. 9 is an enlarged, perspective view of an adaptor for the bar spout faucet.

As can be best viewed in FIG. 8 of the drawings, the spout hub 163 has internal threads 191 which engage the threads 184 of the adapter 159. The spout hub has a passage 193 which receives the spout 161. The spout hub 163 has an interior annular groove 195 which receives a split locking ring 197 to hold the spout 161 in position in the spout hub. The spout inlet 199 seats in the outlet 183 of the spout adapter 159. The spout hub with its installed split locking ring 197 is positioned over the end of the spout 161 and is threaded onto the exterior threads 184 of the adapter. The spout includes a circumferentially outwardly opening groove 201 located next to the spout outlet 199 and a second similar groove 203 located away from groove 201. An O-ring 205 is located in groove 201 and a seal ring 207 is located in groove 203 and seats on the shoulder 185 of the adapter 159. An aerator assembly 209 fits on the outer end of the spout and a lift rod 211 is provided extending through the passage 177.

To install the bar spout trim set 153 on a valve body 13 which has already been attached to a sink deck 41, it is first necessary to place the O-ring 205 and the seal ring 207 in their respective grooves 201 and 203 near the inlet end 199 of the spout 161. The inlet end 199 of the spout is then inserted into the outlet 183 of the spout adapter 159 until the seal ring 207 seats against the shoulder 185 of the spout adapter 159. The spout adapter is then positioned with its water inlet socket 181 fitting over the nipple 25 of the valve body 13. The adapter is positioned in the escutcheon 155 with its flat wall 189 engaging the flat area 173 of the passage 171 through the escutcheon thereby aligning the adapter with the nipple 25. The faucet bonnets 63 may then be threaded onto the tubular conduits 15 of the valve body to complete the assembly.

The invention claimed is:

1. A modular two handled bar spout for installation on a sink deck having a pair of spaced apart passages extending therethrough, said bar spout including:

a valve body and trim set, said valve body including a pair of elongated, tubular conduits spaced from each other to extend trough said passages in said sink deck, a cartridge chamber formed in each of said elongated tubular conduits, a cross conduit connecting said tubular conduits, a water outlet leading from said cross conduit, said water outlet having a slide-on fitting located above said sink deck when said pair of elongated, tubular conduits extend through said passages, said trim set including an escutcheon, a spout adapter and a spout assembly, said escutcheon having an open bottom and a spout connecting passage fanned in its top, said spout adapter positioned in said escutcheon, said spout adapter having a slide-on inlet connection to receive said slide-on fitting of said water outlet of said valve body and a spout adapter outlet connection to receive said spout assembly, and said spout assembly including a spout having an inlet end and an outlet end, said inlet end formed to be received in said spout adapter outlet connection, a hub positioned over said spout inlet end and connected to said spout adapter outlet connection to fasten said spout assembly to said spout adapter.

2. The modular two handled bar spout of claim 1 in which said spout connecting passage of said escutcheon includes a planar wall and said spout adapter includes a complementary planar surface which engages said escutcheon planar wall to orient said spout adapter relative to said escutcheon.

3. The modular two handled bar spout of claim 1 in which said hub includes interior threads which engage exterior threads of said spout adapter and a locking ring which engages said spout.

4. A modular faucet assembly mounted on a sink deck comprising:

a waterway;

a spout adapter having an adapter inlet and an adapter outlet; said adapter inlet is slidingly connected to an end of said waterway to permit water to flow from said waterway into said spout adapter;

a trim set connected to said adapter outlet to permit water to flow from said spout adapter into said trim set.

5. The modular faucet assembly of claim 4, wherein said end of said waterway is disposed above the sink deck.

6. The modular faucet assembly of claim 4, wherein said adapter outlet is larger than said adapter inlet.

7. The modular faucet assembly of claim 4, wherein said adapter inlet is slidingly disposed over said end of said waterway.

8. The modular faucet assembly of claim 4, wherein said trim set is threadedly connected to said adapter outlet.

9. The modular faucet assembly of claim 8, wherein said trim set includes internal threads which engage external threads of said adapter outlet.

10. The modular faucet assembly of claim 4, wherein said trim set comprises a spout, a spout hub and an escutcheon, wherein said spout includes a spout inlet disposed within said adapter outlet wherein said spout hub is disposed over an exterior of said adapter outlet; and wherein said spout adapter is positioned in said escutcheon.

11. The modular faucet assembly of claim 4, wherein said trim set comprises an escutcheon and said escutcheon includes a passage having a flat area;

wherein said adapter includes a flat wall;

wherein said spout adapter is disposed within said passage of said escutcheon; and wherein said flat wall of said adapter is aligned with said flat area of said passage.

12. The modular faucet assembly of claim 4, further comprising:

a cross conduit connecting a hot water supply and a cold water supply to said waterway; and wherein said cross conduit is disposed above said sink deck.

13. The modular faucet assembly of claim 12, wherein a hot water supply valve is disposed between said hot water supply and said cross conduit said hot water supply valve is operable to control flow rate of hot water coming from said hot water supply into said cross conduit; and wherein a cold water supply valve is disposed between said cold water supply and said cross conduit, said cold water supply valve is operable to control flow rate of cold water coming from said cold water supply into said cross conduit.

14. The modular faucet assembly of claim 13, wherein said trim set comprises an escutcheon and said escutcheon covers said hot water supply valve, said cold water supply valve and said cross conduit.

15. A method of installing a modular faucet from above a sink deck in which an end of a waterway extends through an opening in said sink deck, comprising the steps of:

connecting an inlet of an adapter to said end of said waterway; and connecting an inlet end of a trim set to an outlet of said adapter.

16. The method of claim 15, wherein said inlet of said adapter is slidingly disposed over said end of said waterway.

17. The method of claim 15, further comprising the steps of:

positioning said adapter in an opening of an escutcheon such that a flat wall of said adapter is aligned with a flat area of said opening; and tightening a spout hub onto said adapter, said spout hub having internal threads which engage external threads on said adapter.

18. The method of claim 15, further comprising the step of:

placing an escutcheon over a valve assembly, said valve assembly includes a hot water supply valve, a cold water supply valve and a cross conduit, said cross conduit connects said hot water supply valve and said cold water supply valve to said waterway and is disposed above said sink deck.

* * * * *